US006508464B2

(12) United States Patent
Dorer

(10) Patent No.: US 6,508,464 B2
(45) Date of Patent: Jan. 21, 2003

(54) METHOD AND DEVICE FOR INTERMEDIATE STORAGE OF DOCUMENTS

(75) Inventor: Wilfried Dorer, Donaueschingen (DE)

(73) Assignee: Mathias Bäuerle GmbH, St. Georgen (DE)

( * ) Notice: Subject to any disclaimer, the term of this patent is extended or adjusted under 35 U.S.C. 154(b) by 83 days.

(21) Appl. No.: 09/740,070

(22) Filed: Dec. 18, 2000

(65) Prior Publication Data

US 2001/0004142 A1 Jun. 21, 2001

(30) Foreign Application Priority Data

Dec. 18, 1999 (DE) ..... 199 61 179

(51) Int. Cl.[7] ..... B65H 7/00
(52) U.S. Cl. ..... 271/256; 271/3.01; 271/258.02
(58) Field of Search ..... 271/3.01, 256, 271/258.02, 258.01, 202, 272

(56) References Cited

U.S. PATENT DOCUMENTS 4,200,276 A * 4/1980 Marschke ..... 271/202
4,657,237 A * 4/1987 Hansch ..... 198/732
5,364,085 A * 11/1994 Kennish ..... 270/58.01
5,505,440 A * 4/1996 Uematsu ..... 271/182
5,761,535 A * 6/1998 Neifert et al. ..... 209/539
6,095,512 A * 8/2000 Vijuk et al. ..... 271/3.01
6,338,479 B1 * 1/2002 Van Der Werff et al. ... 271/256

* cited by examiner

*Primary Examiner*—Christopher P. Ellis
*Assistant Examiner*—Richard Ridley
(74) *Attorney, Agent, or Firm*—Gudrun E. Huckett

(57) ABSTRACT

In a method for intermediately storing documents being supplied in a supply cycle by an upstream system to an intermediate storage device, the documents supplied by the upstream system to a downstream system are transferred in a transfer cycle that is independent of the supply cycle. The intermediate storage device for performing the method has an input side and an output side and a transport device for transporting the documents from the input side to the output side in a transport direction through the intermediate storage device. The transport device has a first transport unit and a second transport unit. The first transport unit is arranged at the input side and is configured to be continuously driven. The second transport unit is arranged at the output side and is driven in a cycled operation.

18 Claims, 4 Drawing Sheets

METHOD AND DEVICE FOR INTERMEDIATE STORAGE OF DOCUMENTS

BACKGROUND OF THE INVENTION

1. Field of the Invention

The invention relates to a method for the intermediate storage of documents which are supplied from a system arranged upstream to a system arranged downstream. The invention furthermore relates to a device for performing the method, comprising a transport device with transport elements configured to transport the documents through the device.

2. Description of the Related Art

It is known to supply documents or document sets coming, for example, from a folding device or a feeder, to a system arranged downstream, for example, a system for enveloping the documents, a packaging or foil-wrapping device or the like. Between the upstream and downstream systems an intermediate storage device is provided which is in the form of a chain conveyor. The documents or document sets coming from the system upstream are successively deposited on the chain conveyor. When a document or a document set is required in the system downstream, the chain conveyor is switched on and the document or document set is supplied to the system downstream. Depending on the number of documents contained in the document sets, the document sets are not supplied by the system upstream of the chain conveyor in such numbers as required by the system downstream. This has the consequence, that empty positions result on the chain conveyor which cause a reduction of capacity of the device.

SUMMARY OF THE INVENTION

It is an object of the present invention to design the method and the device of the aforementioned kind such that the capacity of the device is increased.

In accordance with the present invention, this is achieved in regard to the method in that the documents are transferred to the downstream system independently of the supply cycle of the system upstream.

In accordance with the present invention the object is achieved in regard to the device in that the transport device comprises a continuously driven transport unit at the input side and a cycled or intermittently driven transport unit at the output side.

According to the method of the invention, the documents are transferred to the system downstream independently of the supply cycle of the upstream system. For this purpose, the transport device is provided with two independently driven transport units. The transport unit positioned at the input side is operated continuously, so that the documents coming from the upstream system are immediately transported into the intermediate storage device. The transport unit provided at the output side, on the other hand, is operated in a cycled fashion (intermittently). In accordance with the document demand of the system arranged downstream, the documents are supplied by the cycled transport unit to the system arranged downstream. Since at the input side the transport unit is operated continuously, the documents can be supplied in larger numbers than are released at the exit side. With the method according to the invention and the device according to the invention, a decoupling of supply and removal of the documents is realized. Accordingly, when in the upstream system the sets of documents have different numbers of sheets, it is avoided that empty spaces between the documents result in the intermediate storage device. In this way, a very high capacity of the intermediate storage device according to the invention results. The upstream systems can thus be continuously driven even when fluctuations of the number of sheets belonging to a document set occur because the transport unit at the input side is also continuously driven.

DESCRIPTION OF THE PREFERRED EMBODIMENTS

The device serves for realizing intermediate storage of documents such as individual sheets, sets comprised of several sheets, and the like. The device has arranged upstream thereof, for example, a folding device, a feeder, a cutter with accumulator or the like. The documents or document sets coming from the upstream systems enter the intermediate storage device according to the invention and are intermediately stored therein before they are transferred onto a system arranged downstream, such as an enveloping system, packaging or foil wrapping devices, extended conveyors etc. By means of the intermediate storage device a decoupling of the supply and removal cycles occurs. Differences in the supply and removal cycles, for example, can occur for varying numbers of documents per document set. For example, when in the upstream system sets of documents are formed which are comprised of different numbers of document, the document sets enter the intermediate storage device at different time intervals. The intermediate storage ensures that the systems arranged downstream can be supplied with the document sets in a constant cycle. This ensures a high throughput of documents or document sets. The systems arranged upstream can operate continuously even when the number of documents to be combined into sets fluctuates.

Figure 1:
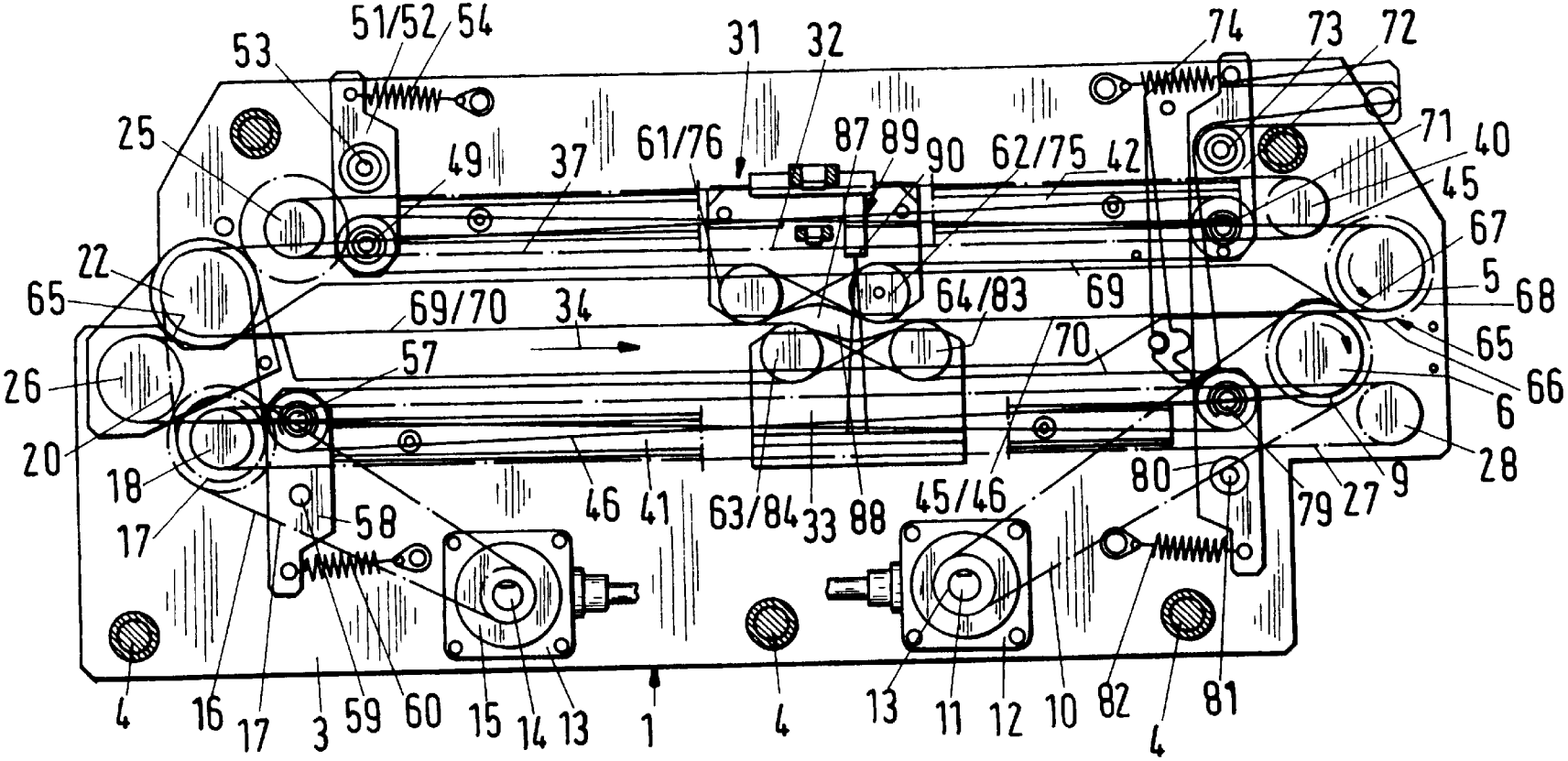
FIG. 1 is a schematic representation of a side view of the device according to the invention.

The device has a frame 1 with planar sidewalls 2, 3 which are connected to one another by transverse stays 4. At the end of the intermediate storage device facing the system arranged downstream (not shown), two horizontal shafts 5, 6 are supported rotatably in the sidewalls 2, 3. On the ends of the two shafts 5, 6 projecting past the sidewall 2 gears 7, 8 are positioned which mesh with one another. On the end of the shaft 6 projecting past the sidewall 3, a pulley 9 is seated about which a drive belt 10 is guided. The drive belt 10 connects the shaft 6 with a drive shaft 11 of a drive motor 12*a* which is fastened at the inner side of the sidewall 3. The drive belt 10 is guided about the pulley 13 which is fixedly seated on the end of the drive shaft 11 projecting past the sidewall 3 to the exterior. As is illustrated in FIG. 1, the drive motor 12*a* is fastened close to the bottom at the inner side of the sidewall 3. The shaft 6, driven by the afore described belt drive 10, drives the shaft 5 via the gears 7, 8. Since the two gears 7, 8 have the same diameter, the two shafts 5, 6 are driven at the same rotational speed (rpm).

As illustrated in FIG. 1, the shaft 5 is positioned closer to the output end of the intermediate storage device than the shaft 6 whose axis is positioned in the area below the shaft 5.

At a spacing from the drive motor 12*a,* a further drive motor 12*b* is arranged at the inner side of the frame sidewall 3. It has a drive shaft 14 parallel to the drive shaft 11 so that the drive shaft 14 is thus also parallel to the shafts 5, 6. On the end of the drive shaft 14 projecting past the frame sidewall 3, a pulley 15 is connected fixedly to the shaft 14. The pulley 15 is connected by a drive belt 16 with the pulley 17 which is fixedly seated on the end of the shaft 18 projecting past the frame sidewall 3. Like the shafts 5, 6, the shaft 18 is rotatably supported in the parallel frame sidewalls 2, 3. On the end of the shaft 18 projecting past the frame sidewalls 2, a further pulley 19 is positioned which is connected by a drive belt 20 with a pulley 21. The pulley 21 is fixedly connected to the end of the shaft 22 projecting past the frame sidewall 2. The shaft 22 is parallel to the shafts 5, 6 and rotatably supported in the two frame sidewalls 2, 3. Adjacent to the pulley 21 a gear 23 is positioned on the shaft 22 which meshes with a gear 24 that is fixedly seated on an end of the shaft 25 projecting past the frame sidewall 2. The shaft 25 is positioned parallel to the shaft 22 and is rotatably supported in the frame sidewalls 2, 3. The two gears 23, 24 have the same diameter so that the two shafts 22, 25 rotate at the same rotational speed (rpm). The axis of the shaft 22 is arranged in the area underneath the shaft 25. Moreover, the shaft 22, as illustrated in FIG. 1, is closer to the neighboring end of the frame 1 than the shaft 25.

In the area between the shafts 18 and 22, a shaft 26 extending parallel to the shafts 18, 22 is provided whose two ends are rotatably supported in the frame sidewalls 2, 3.

The shaft 18 is connected by a drive belt 27 with a shaft 28 which is arranged in the area underneath the shaft 6 approximately at the level of the shaft 7 and extends parallel to the shafts 6 and 7. The shaft 28 is rotatably supported with its ends in the two frame sidewalls 2, 3. The drive belt 27 is positioned adjacent to the inner side of the frame sidewall 2 and is guided about pulleys 29, 30 which are fixedly seated on the shafts 18, 20, receptively. The various drive belts 10, 16, 20, and 27 are advantageously toothed belts.

In the area between the frame sidewalls 2, 3, a carriage 31 is arranged which is comprised of two carriage units 32 and 33 (FIG. 1) arranged above one another. They extend perpendicularly to the frame sidewalls 2, 3. As illustrated in FIG. 1, the carriage units 32, 33 arranged above one another are arranged in the transport direction 34 of the documents in a spaced arrangement. The lower carriage unit 33 is connected fixedly with the drive belt 27 so that it is driven by means of this belt drive in and counter to the transport direction 34. Adjacent to the inner side of the frame sidewall 3 a drive belt is provided, also not shown, which is guided about the pulleys 35, 36 seated fixedly on the shafts 18, 20. In this way, the lower carriage unit 33 is driven on both sides.

Moreover, the upper carriage unit 32 is driven on both sides by belt drives. For this purpose, belt drives which are of identical design are provided adjacent to the inner side of the frame sidewalls 2, 3. As can be seen in FIG. 1, the drive belt 37 of the corresponding belt drive is guided about pulleys 38,39 on the shaft 25 and about pulleys (not shown) on a shaft 40 (FIG. 1). The pulleys 38, 39 are positioned in the area between the two frame sidewalls 2, 3. The shaft 40 is rotatably supported with its ends in the frame sidewalls 2, 3 and is positioned approximately at the level of the shaft 6. The axis of the shaft 40 is furthermore positioned in the area above the shaft 5.

The drive belts 27, 37, which are advantageously in the form of toothed belts, are fastened on the carriage units 32, 33.

Figure 2:
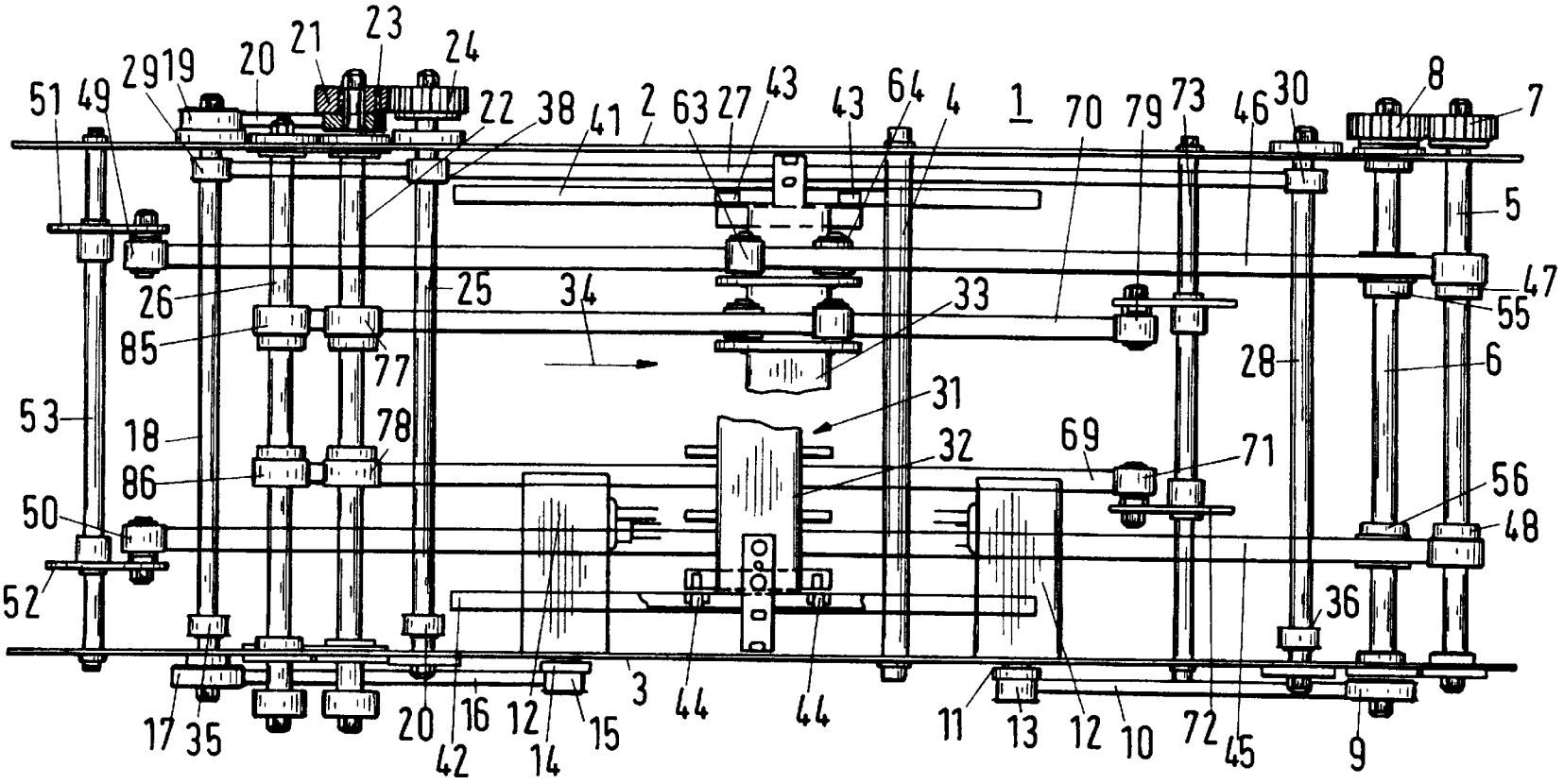
FIG. 2 is a plan view onto the device according to FIG. 1, wherein, in order to simplify the drawing, parts that are positioned on top of one another are illustrated adjacent to one another.
Figure 3:
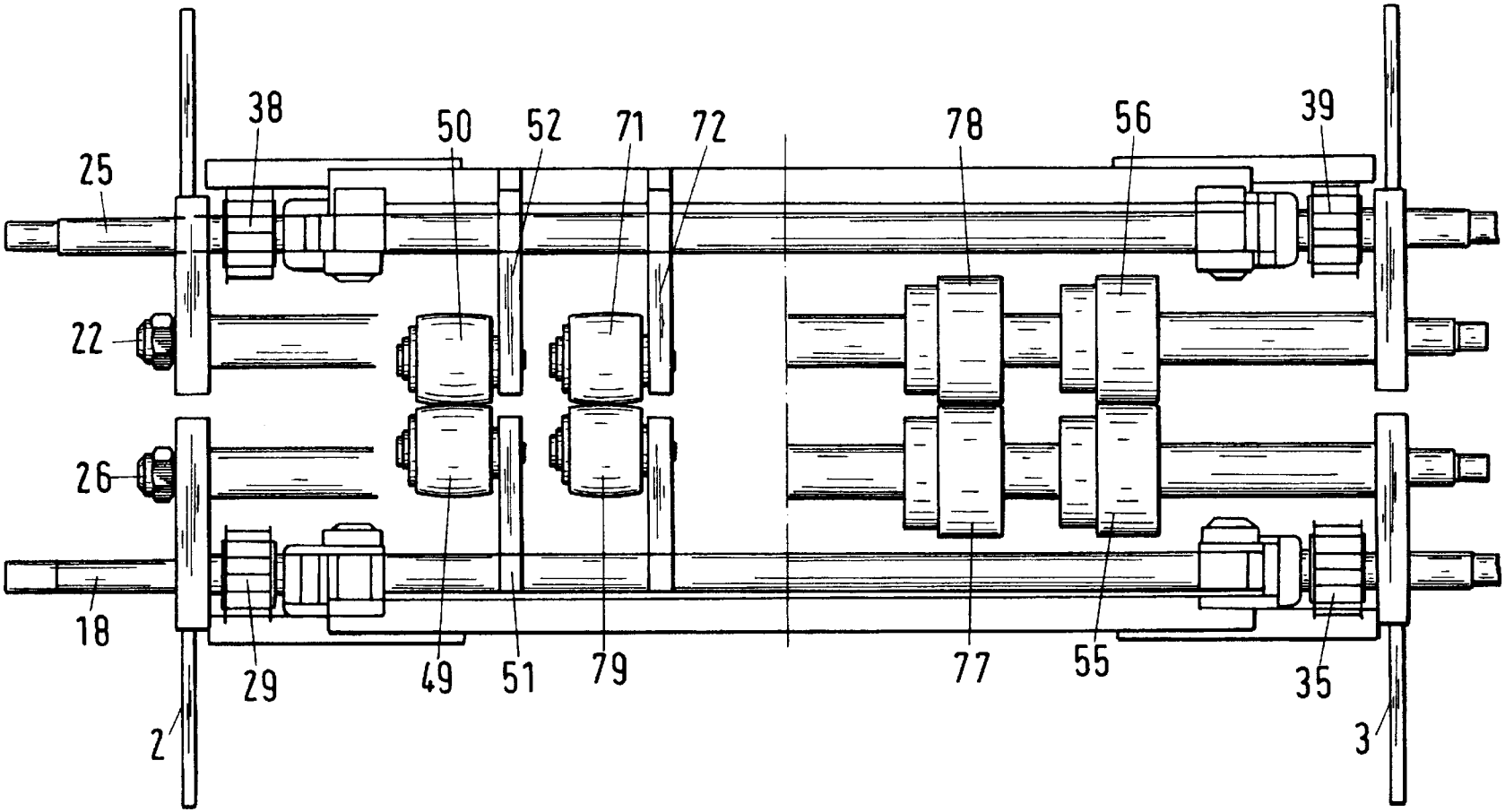
FIG. 3 is an end view of the device according to FIG. 1.

In order for the carriage units 32, 33 to be properly guided and supported during movement, guide members in the form of rails 41,42 (FIG. 2) extending in the transport direction 34 are provided adjacent to the inner sides of the frame sidewalls 2, 3. The carriage units 32, 33 are supported by running wheels 43, 44 on the rails 41, 42. The running wheels 43, 44 are provided on the narrow sides of the carriage units. In FIG. 2, each carriage unit 32, 33 is illustrated with only one rail 41, 42. Both ends of the carriage units 32, 33 are supported by means of the running wheels 43,44 on a rail, respectively. Advantageously, each carriage unit 32, 33 is provided at both ends with running wheels 43, 44 that are positioned at a spacing successively in the longitudinal direction of the rail so that the carriage units 32, 33 are supported properly. The rails 41, 42 are fastened in a suitable manner on the facing inner sides of the frame sidewalls 2, 3.

In the intermediate storage device the documents or sets of documents are transported by transport elements, preferably in the form of transport belts 45, 46, in a manner to be described in the following (FIGS. 1 and 2). The transport belts 45, 46 are advantageously configured as flat belts. As illustrated in FIGS. 1 and 2, in the area between the frame sidewalls 2, 3 two transport belts 45, 46 are positioned at a spacing adjacent to one another, respectively. The two upper transport belts 45 as well as the two lower transport belts 46 are embodied as endless or continuous belts. The upper transport belts 45 are guided by pulleys 47, 48 on the shaft 5 at the output side and by tensioning rolls 49, 50. The tensioning rolls 49, 50 are connected freely rotatably on two-arm levers 51, 52 which are seated on an axle 53 whose two ends are fastened in the frame sidewalls 2, 3. The axle 53 is positioned parallel to the neighboring shaft 25. The tensioning rolls 49, 50 are arranged on one of the lever arms. A tension spring 54 (FIG. 1) engages the other lever arm and loads the levers 51, 52 such that the transport belts 45 are maintained under tension.

The lower transport belts 46 are guided about pulleys 55, 56 on the shaft 6 (FIG. 2) through the lower carriage unit 33 and about tensioning rolls 57; only one tensioning roll 57 is illustrated in the drawings. The tensioning rolls 57 are seated on two-arm levers 58 which are seated on an axle 59 extending parallel to the axle 53. The tensioning rolls 57 are connected freely rotatably on one of the lever arms. A tension spring 60 engages the other lever arm, respectively, and loads the lever 58 such that the transport belts 46 are tensioned. The levers 51, 52, 58 are positioned in the area between the frame sidewalls 2, 3.

In the area between the shafts 5, 6 and the carriage units 32, 33 the upper and lower transport belts 45, 46 rests against one another. The documents or document sets are transported between them.

The upper carriage unit 32 is provided with two guide pulleys 61, 62 for the parallel positioned upper transport belts 45. The pulleys 61, 62 are positioned successively at a spacing to one another in the transport direction 34 at the same level and are rotatable about a horizontal axle, respectively. As can be seen in FIG. 1, the lower run of the upper transport belts 45 is guided from below about the guide pulley 62. From the guide pulley 62 the lower run is guided about the following guide pulley 61. Accordingly, the portion of the lower run of the transport belts 45 positioned between the shaft 5 and the carriage unit 32 is arranged lower than the lower run positioned between the carriage unit 32 and the tensioning rolls 49, 50.

The lower carriage unit 33 is also provided with two guide pulleys 63, 64 for the two transport belts 46, respectively. The transport belts 46 are positioned parallel to one another and are located below the upper transport belts 45. The guide pulleys 63, 64 are positioned at a spacing successively in the transport direction 34 (FIG. 1). The upper run of the lower transport belts 46, coming from the shaft 6, is guided about the guide pulley 64 and deflected such that it is guided below the guide pulleys 63 to the tensioning rolls 57. As a result of the above described guiding, the portion of the upper run of the transport belts 46 positioned between the shaft 6 and the lower carriage unit 33 is arranged higher than the portion of the upper run of the transport belt 46 between the carriage unit 33 and the tensioning rolls 57.

Because of the two carriage units 32, 33, the upper and the lower transport belts 45 and 46 are separated from one another in the way described above upon entry into the carriage 31.

A guide 65 for the documents and document sets is provided in the area. above the pulleys 47, 46 of the shaft 5. As illustrated in FIG. 1, this guide 65 has a central horizontal part 66 and adjoining end parts 67, 68 extending to the front and to the back in the transport direction 34 and being slanted upwardly in opposite directions. The end parts 67, 68 extend into close proximity to the circumference of the pulleys 47,48. By means of this guide 65 the document or document set reaching the downstream system is supplied properly into the area between the pulleys 47, 48 and 55, 56 of the shafts 5, 6.

The transport belts 45, 46 are driven in a cycled fashion so that the documents or document sets can be supplied in the desired fashion to the system arranged downstream in a way to be described in the following.

The intermediate storage device is also provided with continuously driven transport elements, preferably in the form of transport belts 69, 70, in addition to the transport belts 45, 46 being driven in a cycled fashion. The continuously driven transport belts 69, 70 are arranged in the area between the transport belts 45, 46, when viewing the intermediate storage device in a plan view (FIG. 2). By means of the upper carriage unit 32 two transport belts 69 are provided which are positioned at a spacing adjacent to one another in the transport direction 34 and parallel to the transport belts 45, 46. In the same way, by means of the lower carriage unit 33 two transport belts 70 are provided which extend parallel to the transport belts 69. The transport belts 69, 70 are formed as continuous belts in the same way as the transport belts 45, 46 and are preferably in the form of flat belts.

The upper transport belts 69 are guided about a tensioning roll 71, respectively, which is rotatably supported on one arm of a two-arm lever 72. It is pivotably supported on an axle 73 which extends parallel to the axle 53. The two ends of the axle 73 are supported in the frame sidewalls 2, 3. A tension spring 74 engages the other lever arm of the levers 72 (FIG. 1), respectively, and pivots the lever 72 such that the transport belts 69 have sufficient tension. The tensioning rolls 71 are positioned, as illustrated in FIG. 1, in the area adjacent to the shaft 40 on the side facing the carriage 31. The lower run of the upper transport belt 69 extends from the tension rolls 71 via guide pulleys 75 of the upper carriage unit 32. The lower run is deflected at the guide pulleys 75 in the downward direction to the guide pulleys 76 which are supported in a freely rotatable manner at a spacing behind the guide pulleys 75 at the upper carriage unit 32. The guide pulleys 75, 76 are positioned at the same level as the guide pulleys 61, 62 and are aligned with them. The lower run of the upper transport belts 69 is then guided via the pulleys 76, 78 on the shaft 22. The upper run of the transport belts 69 extends from the pulleys 77, 78 to the tensioning rolls 71.

The lower transport belts 70 are guided about tensioning rolls 79 which are supported freely rotatably about horizontal axes on the lower arm of a two-armed lever 80. The levers 80 are seated on an axle 81 (FIG. 1) positioned parallel to the axle 53. The ends of the axle 80 are supported in the two frame sidewalls 2, 3. A tension spring 82 engages the other lever arm, respectively, and loads the lever 80 such that the lower transport belts 70 are sufficiently tensioned, respectively. When viewing the intermediate storage device in a plan view, the axle 81 is positioned congruently to the upper axle 73.

The upper run of the lower transport belts 70 is guided from the tensioning rolls 79 underneath the guide pulleys 82 of the lower carriage unit 33. At the guide pulleys 83, the upper run of the lower transport belts 70 is guided via successively arranged guide pulleys 84 of the lower carriage unit 33 (FIG. 1). From here, the upper run of the transport belts 70 extends to the pulleys 85, 86 on the shaft 26 (FIG. 2). The transport belts 70 are deflected by the pulleys 85, 86 toward the tension rolls 79.

In contrast to the transport belts 45, 46, the transport belts 69, 70 are driven constantly. The drive of the upper transport belts 69 is realized via the shaft 22 which is driven via drive belt 20 by the shaft 18. The shaft 18 is connected via drive belt 16 with the drive shaft 14 of the drive motor 12b. The lower transport belts 70 are driven by the shaft 26. The upper and lower transport belts 69, 70 are positioned in the area between the carriage 31 and the shafts 22, 26 so as to rests against one another so that between them the documents or sets of documents can be transported. In the carriage 31, the upper and lower transport belts 69, 70 are then guided away from one another by the guide pulleys 75, 76 and 83, 84 so that they extend from the carriage 31 to the tensioning rolls 71, 79 at a spacing to one another. In this area, the transport of the documents or sets of documents is realized by the transport belts 45, 46 resting against one another. The transport belts 45, 46 are also guided away from one another in the carriage 31 so that in the area between the carriage 31 and the tensioning rolls 49, 50; 57 they are positioned at a spacing to one another. As illustrated in FIG. 1, the areas of the transport belts 45, 46 and 69, 70 resting against one another are positioned in a common plane.

The transport belts 45, 46 are driven in rotation by the shafts 5 and 6. The shafts 5, 6 themselves are driven via drive motor 12*a* and the belt drive 13, 10, 9 in rotation. By means of the meshing gears 7, 8, the shafts 5, 6 are driven in opposite directions relative to one another.

The upper carriage unit 32 comprises at the side facing the lower carriage unit 33 a substantially V-shaped depression 87 which has its greatest depth at half the width of the carriage element 32. In the area adjacent to the depression 87 the guide pulleys 61, 62; 75, 76 are arranged which project slightly past the carriage unit 32 in the direction toward the lower carriage unit 33.

The lower carriage unit 33 also has at half its width a V-shaped depression 88 which has its greatest depth at half the width of the carriage unit 33. The guide pulleys 63, 64;

83, 84 which, when viewed in the axial direction, are positioned congruently to one another, are located on opposite sides of the depression 88 and project slightly in the direction toward the upper carriage unit 32.

The lower carriage unit 33 is displaced relative to the upper carriage unit 32 in the transport direction 34 of the documents in the direction toward the shafts 5, 6. The displacement or spacing corresponds approximately to the diameter of the guide pulleys of the carriage 31.

Figure 4:
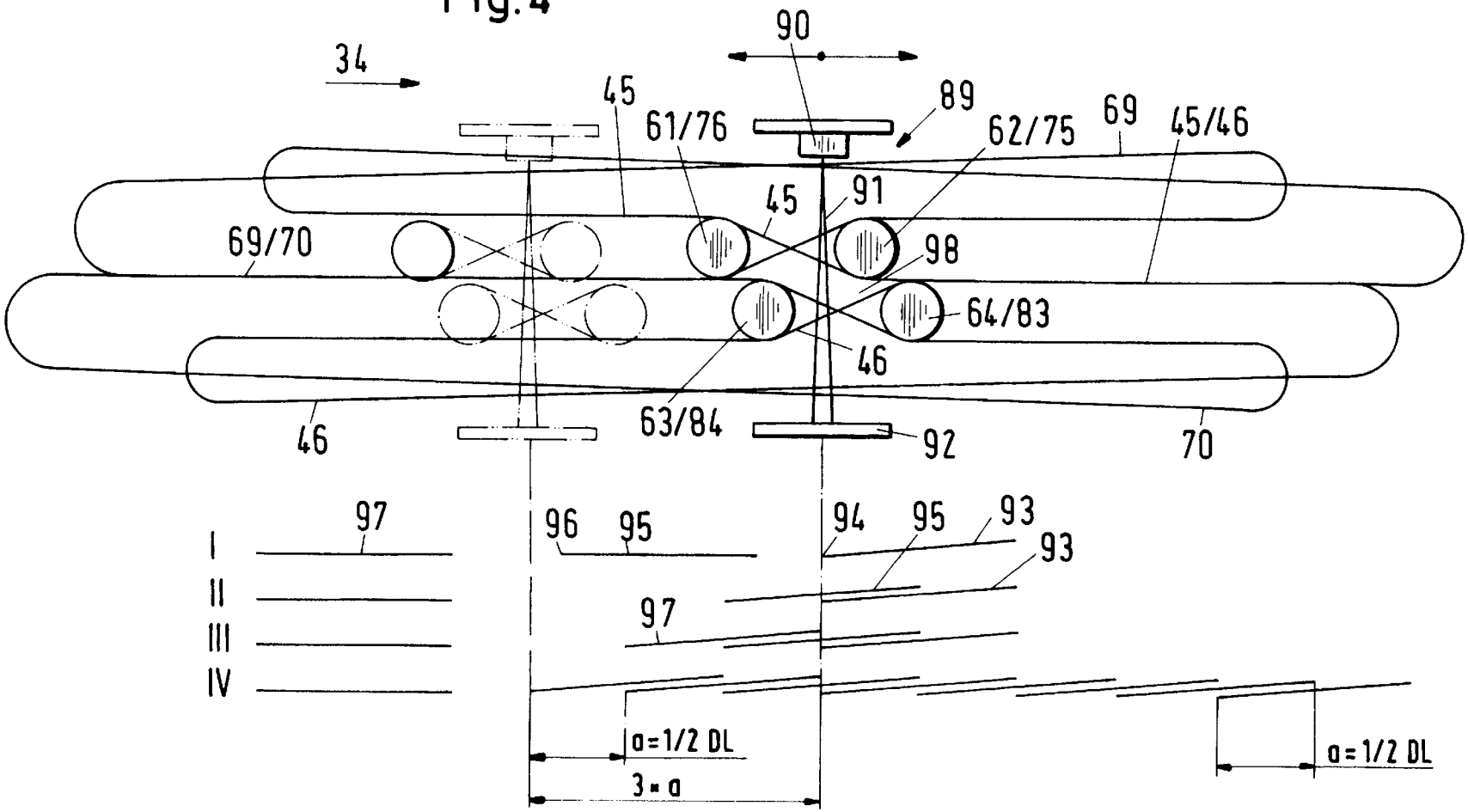
FIG. 4 shows schematically the method steps when using the device according to the invention.

The carriage 31 is provided with a light barrier 89, which comprises a sender 90 in the upper carriage unit 32. As illustrated in FIG. 4, the light beam 91 emitted by the sender 90 impinges on a receiver provided at the lower carriage unit 33. The light beam 91 is oriented perpendicularly to the transport direction 34.

The light barrier 89 is positioned advantageously in the area between the continuously driven transport belts 69, 70.

Document sets or individual documents are supplied from the system arranged upstream into the area between the shafts 22, 26 an the inlet side. In the same way as in the case of the shaft 5 at the output side, a guide 65 is provided at a minimal spacing below the shaft 22 at the inlet side. The guide 65 ensures that the document sets supplied by the system arranged upstream can reach reliably the space between the transport belts 69, 70.

With the aid of FIG. 4, the method steps are to be explained in more detail. First, a first document set 93 is transported to the transport belts 69, 70 up to the carriage 31. As soon as the rear edge 94 of the document set 93 has passed the light barrier 89, the document set 93 reaches the space between the transport belts 45, 46 which are not driven in this phase. The document set 93 remains thus in the position illustrated in FIG. 4. Advantageously, the spacing of the document set 93, resting in the intermediate storage device, from the shafts 5, 6 at the output side corresponds to the length of the document set 93 measured in the transport direction 34. After the rear edge 94 of the first document set 93 has passed the light barrier 89 of the carriage 31, the drive motor 12*b* receives an actuation signal and is switched on. Via the drive belt 16 the shaft 18 is driven so that the carriage 31 is returned by a predetermined amount counter to the transport direction 34 by means of the drive belts 27. This amount is advantageously half the length DL of the document set 93. As soon as the carriage 31 has reached its new position, the drive motor 12*b* is switched off. The switch signal for switching off the motor can be generated by a further light barrier which is interrupted when the carriage 31 is retracted. It is also possible to move the carriage 31 by travel control. During this return of the carriage 31 the transport belts 69, 70 are driven while the transport belts 45, 46 stand still. The document set 93 therefore remains at its location within the intermediate storage device.

Now the next document set 95 coming from the system arranged upstream is transported by the transport belts 69, 70 into the intermediate storage device until the rear edge 96 of the document set has passed the light barrier 89 of the returned carriage 31. This document set 95 is now inserted between the resting transport belts 45, 46 in the area of the carriage 31. Since the transport belts 45, 46 are not driven, the document set 95 is then no longer transported any further when it has left the area between the constantly driven transport belts 69, 70.

The carriage 31 is subsequently returned in the described manner by the travel stroke a in the direction of the input side of the intermediate storage device. The next document set 97 is then supplied in the described fashion until it has passed the light barrier 89 of the carriage 31.

In the embodiment according to claim 4, the carriage 31 is returned three times by the travel stroke a. Depending on the dimensions of the intermediate storage device, the carriage 31 can also be returned by a smaller or larger travel stroke in a cycled fashion.

When the system arranged downstream now demands a document set, the drive motor 12*a* receives a signal from the system arranged downstream so that it drives via the belt drive 13, 10, 9 the shafts 5, 6 at the output side. Accordingly, the drive belts 45, 46 are driven. With these drive belts 45, 46, the respective document set is moved farther by a predetermined length a which in the shown embodiment corresponds to half the document length DL. Now the drive motor 12*a* is switched off so that the drive of the transport belts 45, 46 is terminated. In this way, the individual document sets, which are intermediately stored in the intermediate storage device, are successively transported in a cycled fashion through the intermediate storage device to the system arranged downstream. The individual document sets overlap one another like scales wherein the overlap length a is advantageously half the document length. Simultaneously with the cycled drive of the transport belts 45, 46, the carriage 31 is also moved in the transport direction 34 about the same travel stroke in the direction toward the shafts 5, 6 at the output side. The carriage drive in the form of the drive belts 27 receives in the same way as the drive motor 12*a* a corresponding switching signal from the system arranged downstream so that the carriage 31 is moved farther simultaneously with the transport belts 45, 46.

The scale-like overlap of the individual document sets is achieved in that between the two carriage units 32, 33 an area without drive action is provided because the transport belts 69, 70 are guided away from one another by the guide pulleys 61, 63, 76, 84 arranged rearwardly in the transport direction 34 and the transport belts 45, 46 are guided together or combined by means of the guide pulleys 62, 64, 75, 83 successively arranged in the transport direction 34. The spacing of the guide pulleys in the transport direction 34 is smaller than the length DL of the document sets to be transported by the intermediate storage device. The transport belts 45,46 converge within the carriage 31 in the transport direction so that an insertion slot 98 which narrows in the transport direction 34 is formed in the area between the guide pulleys 62, 64, 75, 83. Its lower delimitation is formed by the transport belts 46 and extends in the transport direction 34 at an upward incline while the upper delimitation of the insertion slot 98 which is formed by the upper transport belts 45 extends horizontally. The respectively following document set is thus reliably slipped over the document set positioned in front, as illustrated in an exemplary fashion in FIG. 4.

Since within the intermediate storage device the document sets are positioned in a scale-like overlapping fashion, a large number of document sets can be intermediately stored within a smallest amount of space. This ensures that the system arranged downstream can be supplied in a continuously cycled fashion with document sets, independent of the number of document sets which has been supplied by the system arranged upstream. With the described method a decoupling of the supply cycle and the transfer cycle is thus realized. When, for example, in the system arranged upstream document sets with different numbers of documents are produced, the different document sets are transported in different intervals into the intermediate storage device. As a result of the intermediate storage in the device according to the invention, this does not cause an adapted cycle behavior for the transfer to the system arranged downstream. As a result of the described scale-like overlapped intermediate storage, the document sets can be continuously supplied in a cycled fashion to the system arranged downstream On the other hand, should an error situation occur within the system downstream, the document sets which are supplied with the continuously driven supply system 69, 70 can be intermediately stored in the intermediate storage device.

According to a different operating mode, the carriage 31 can be returned already when the document set 93, 95, 97 interrupts the light barrier 89. The control in this case is designed such that, when the light barrier 89 is interrupted by the leading edge of the respective document set, the drive for the carriage 31 receives a corresponding switching signal.

However, it is also possible to return the carriage 31 with a preset delay as soon as the document set has passed the light barrier 89.

The cycle time of the transport belts 45, 46 can be determined by a light barrier (not shown). However, it is also possible to design the control for the drive motor 12*a* such that the transport belts 45, 46 are transported by a predetermined travel stroke, respectively.

The described intermediate storage device can receive at the same time folded and unfolded documents from the system arranged upstream and transfer them to the system arranged downstream. As a function of the length of the document set and the overlap degree, a different number of document sets can be intermediately stored in the intermediate storage device. In the embodiment illustrated in an exemplary fashion, eight document sets are stored. With the intermediate storage device a very high throughput of document sets is possible. In the case of fluctuations of the number of documents belonging to one document set, the systems arranged downstream are supplied according to their cycle time, respectively.

The document sets are comprised of at least two documents. The document sets are compiled in the system arranged upstream. However, it is, of course, also possible to transport individual sheets or documents with the intermediate storage device. In this case, a document set is a single sheet.

While specific embodiments of the invention have been shown and described in detail to illustrate the inventive principles, it will be understood that the invention may be embodied otherwise without departing from such principles.

What is claimed is:

1. An intermediate storage device for performing a method for intermediately storing documents being supplied in a supply cycle by an upstream system to an intermediate storage device, wherein the documents are transferred to a downstream system in a transfer cycle that is independent of the supply cycle, said intermediate storage device (1) having an input side and an output side and comprising a transport device configured to transport the documents from said input side to said output side in a transport direction through said intermediate storage device, wherein said transport device comprises a first transport unit (69, 70) and a second transport unit (45, 46), wherein said first transport unit (69, 70) is arranged at said input side and is configured to be continuously driven, and wherein said second transport unit (45, 46) is arranged at said output side and is configured to be driven in a cycled operation.

2. The device according to claim 1, further comprising one or more carriages (31), wherein said first and second transport units (45, 46; 69, 70) are configured to extend through said carriage (31).

3. The device according to claim 2, wherein said carriage (31) is moveable relative to said first and second transport units (45, 46; 69, 70).

4. The device according to claim 1, wherein said first transport unit (69, 70) is comprised of first upper and lower transport elements (69, 70) configured to cooperate with one another for transporting the documents and wherein said second transport unit (45, 46) is comprised of second upper and lower transport elements (45, 46) configured to cooperate with one another for transporting the documents.

5. The device according to claim 4, wherein said first upper transport elements (69) have an upper run and a lower run, wherein said first lower transport elements (70) have an upper run and a lower run, wherein said lower runs of said first upper transport elements (69) and said upper runs of said first lower transport elements (70) rest against one another, respectively, over a distance extending between said input side and said carriage (31); and wherein said second upper transport elements (45) have an upper run and a lower run, wherein said second lower transport elements (46) have an upper run and a lower run, wherein said lower runs of said second upper transport elements (45) and said upper runs of said second lower transport belts (46) rest against one another, respectively, over a distance extending between said carriage (31) and said output end.

6. The device according to claim 5, wherein in said carriage (31) said first upper and lower transport elements (69, 70) are disengaged form one another and said second upper and lower elements (45, 46) are disengaged from one another.

7. The device according to claim 5, wherein said carriage (31) comprises guide pulleys (61–64; 75–76; 83–84) configured to deflect said first upper and lower transport elements (69, 70) and said second upper and lower transport elements (45, 46).

8. The device according to claim 5, wherein said carriage (31) is comprised of an upper carriage part (32) and a lower carriage part (33), wherein said first and second upper transport elements (69, 45) are guided through said upper carriage part (32) and said first and second lower transport elements (70, 46) are guided through said lower carriage part (33).

9. The device according to claim 8, wherein said upper and lower carriage parts (32, 33) are spaced relative to one another in said transport direction.

10. The device according to claim 4, wherein said first upper and lower transport elements (69, 70) and said second upper and lower transport elements (45, 46) are transport belts.

11. The device according to claim 2, wherein said carriage (31) is configured to be driven independently of said first and second transport units (69, 70; 45, 46).

12. The device according to claim 2, further comprising guide members (41, 42) configured to support said carriage (31).

13. The device according to claim 2, wherein said carriage (31) has at least one sensor device (89) configured to detect a document (93, 95, 97) being transported through said carriage (31).

14. The device according to claim 13, wherein said sensor device is a light barrier.

15. The device according to claim 13, wherein said carriage (31) has a carriage drive (12*b*) and wherein said sensor device (89) is coupled to said carriage drive (12*b*).

16. The device according to claim 4, wherein said second upper and lower transport elements (45, 46) define an insertion slot (98) for the documents, wherein said insertion slot (98) narrows in said transport direction.

17. The device according to claim 16, wherein said insertion slot (98) has a lower slot delimitation with an upward incline in said transport direction.

18. The device according to claim 1, wherein said second transport unit (45, 46) comprises a drive (12*a*) and wherein said drive (12*a*) is configured to be switched on by a signal received from the downstream system.

* * * * *